United States Patent [19]

Drinkard, Jr.

[11] Patent Number: 5,030,483

[45] Date of Patent: Jul. 9, 1991

[54] PROCESS FOR ACCELERATED FIXING OF HEAT-FIXABLE WOOD PRESERVATIVES

[75] Inventor: William F. Drinkard, Jr., Charlotte, N.C.

[73] Assignee: Drinkard Developments, a Delaware Partnership, Charlotte, N.C.

[21] Appl. No.: 525,896

[22] Filed: May 18, 1990

Related U.S. Application Data

[63] Continuation-in-part of Ser. No. 350,604, May 11, 1989, Pat. No. 4,927,627.

[51] Int. Cl.[5] ..... B05D 1/18

[52] U.S. Cl. ..... 427/336; 427/440; 428/541

[58] Field of Search ..... 427/336, 440; 428/541

[56] References Cited

U.S. PATENT DOCUMENTS

| | | | |
|---|---|---|---|
| 4,303,705 | 12/1981 | Kelso | 427/351 |
| 4,649,065 | 3/1987 | Hein et al. | 427/370 |
| 4,716,054 | 12/1987 | Stanek et al. | 427/297 |
| 4,927,672 | 5/1990 | Drinkard | 427/336 |

*Primary Examiner*—Michael Lusignan

*Attorney, Agent, or Firm*—Ralph H. Dougherty

[57] ABSTRACT

A process for the accelerated fixing of fixable chromate-containing wood preservatives in which wood freshly impregnated by any of the full-cell, modified full-cell, empty-cell, or modified empty-cell treating processes are subjected to fixing by contacting the wood with hot liquid medium, such as water, which liquid is either initially hot or is rapidly heated to sufficient temperature so that the entire bundle of wood is brought to a temperature sufficient for fixation to occur within a short economic period of time within the liquid medium. The process also produces a low-weight preservative impregnated wood product.

33 Claims, No Drawings

PROCESS FOR ACCELERATED FIXING OF HEAT-FIXABLE WOOD PRESERVATIVES

CROSS REFERENCE TO RELATED APPLICATION

This application is a continuation-in-part application of copending application Ser. No. 07/350,604, filed May 11, 1989.

BACKGROUND OF THE INVENTION

The field of the present invention is the treatment of wood by impregnation with a treating agent for the purpose of extending the useful life of the wood by the incorporation of a preservative therein.

The present invention relates to a process for the rapid fixing of heat-fixable wood preservatives such as CCA (copper, chromium, and arsenic oxides), CCB (copper, chromium, and boron oxides), ACA (ammoniacal or amine solution of copper and arsenic oxides), or the like, in a time period sufficiently short to be of practical value for modern high speed wood treaters.

The invented process greatly reduces and essentially eliminates drippage and subsequent environmental pollution from wood treated with chromated wood preservatives such as CCA. This process allows complete control of the fixation process, accomplishes the desired fixation in a short period of time, and further, does not delay modern or high speed wood treating operations. On the other hand, steam fixing takes several hours and air curing at ambient conditions takes days, weeks, or sometimes even months, for complete fixation to occur.

The most widely used wood preservative in North America is a mixture of copper, chrome and arsenic oxides, which is available in three types, denoted CCA-A, CCA-B and CCA-C. The C form is the one which has found widest acceptance in the United States. All three types are approved by the American Wood Preservers Association for use in the United States.

It has been established that to completely fix all of the copper, chrome and arsenic components present in CCA, they must be held at 70 F. for approximately 220 hours. Temperatures lower than 70 F. require even longer times.

Until complete fixation occurs, the treated wood is a potential source of environmental contamination. Rain water will wash or leach copper, chrome and arsenic out of the treated lumber and onto or into the soil, thus contaminating the soil over a period of time as the metals build up in the soil. Present EPA regulations define any soil or water that tests above 5.0 ppm for either arsenic or chromium as "hazardous waste", and the site at which they were found is designated "contaminated". Failing such a test results in a requirement for treaters and their customers to decontaminate the site where unfixed wood had been stored by removing and placing in approved hazardous landfills all contaminated soil, water, etc. until the site tests at one-hundredth of the failure level, or less than 0.05 ppm each of arsenic and chromium. From this it can be seen that failure by treaters or their customers to pass EPA tests over any area of consequence could result in economic charges that could be catastrophic. For example, CCA-C at 2.0 percent concentration, a concentration which many wood treaters approach or use in their daily operations, impregnates and coats the wood with up to 3,800 ppm of water-soluble arsenic (expressed as $As_2O_5$) Many individual U.S. treaters put more than a half-million pounds of 100% CCA per year into wood at their treating sites. As the average ambient temperature at which the treated wood is stored outdoors drops below 70 F. and approaches freezing, the time required for the components of CCA on and inside the wood to become water-insoluble becomes greater and approaches infinity. Thus, the value of this invention is readily apparent.

Many of the most successful wood treaters in the United States today are high-speed, high-volume producers. A typical treating cycle is one hour duration, and successful treaters seek to shorten this time. The most expensive individual piece of equipment in a wood treating plant is the pressure treating cylinder, which in an average modern plant is more than 6 feet in diameter and more than 65 feet long with quick-opening double doors, all of which are capable of withstanding treating pressures from full vacuum to over ten atmospheres. Increasing the time that the wood must remain in the pressure cylinder to any degree is very detrimental to the plant's return on investment (R.O.I.). For the same reasons additional pressure vessels are not desirable. What has long been sought is a process that does not add greatly to the capital cost of both existing and new treating plants. This process must also be capable of fixing the preservative by heating the wood so rapidly that the treated wood, in the same bundle as it comes out of the pressure treating cylinder, can be placed into the heating process without restacking. The entire heating portion of the invented fixing process takes no more, and preferably less, time than the pressure treating cycle, so that as each charge of treated wood emerges from the pressure cylinder, it can be immediately placed into the heating process and removed therefrom in time for subsequent charges, thus neither slowing nor interfering with established and proven procedures.

It is also important that the wood not be heated above the temperature which will cause deterioration. With steam at even slightly elevated pressures, destructive temperatures can be reached. In the present invention, using water alone without pressure, commercial wood species commonly treated with these chemicals cannot be overheated, and thus cannot be attacked by destructively high temperatures.

Applicant's initial work in this field was with steam as it is presently being practiced at some plants in Europe. The belief was held, by those highly experienced and skilled in the art of wood treating, that contact with quantities of water would wash active needed preservatives off the surface of the freshly treated wood, and the amount of preservatives, which becomes concentrated in the outer region of the wood, would be smaller in comparison with normally fixed timbers. (See Stanek et. al. U.S. Pat. No. 4,716,054, column 1, lines 37–41). This is also the most likely reason that Kelso U.S. Pat. No. 4,303,705, requires heating under pressure with the treating solution containing wood treating chemicals in his one example of aqueous (non steam) heating in column 4. When utilizing this Kelso procedure, it has been found that the quantity of hazardous waste formed by heating with the treating solution is so great as to be undesirable, as well as uneconomic, particularly with today's increasingly stringent environmental requirements.

The American Wood Preservers Association requires that certain chemical retentions be present in the outer layers of the wood. Therefore, it is important to secure quick-fixation without depleting the wood of the required content or level of preservative in its outer layer. In continuing work and testing by applicant, it has been determined that preservative fixation in only the outer layer is suitable for many environmental conditions. Often, only one-quarter inch of fully fixed preservative depth is satisfactory. Therefore, it is possible to shorten the time of the fixation process and still prevent surface washoff of preservative. Thus, a short time shallow fixation treatment is not only suitable, but all that may be required. Such shallow treatment is suitable for hemlock fir, Douglas fir, and southern yellow pine, among other woods.

A minor, but not insignificant, need in treated wood is for the treated wood to have some color difference from untreated wood. Present U.S. practice, which is almost exclusively based on allowing the treated wood to stand in open areas, results in vastly differing shades ranging from bright green to almost brown, depending on temperature and solar exposure. This extreme color variation is unsightly and visually detrimental for many applications such as decks, fences, and many other unpainted applications. The invented process produces a much more uniform wood surface color.

It is preferable not to heat the pressure cylinder, because the heavy cylinder walls act as a heat sink. The heat thus contained accelerates the reaction of the CCA solution that is later charged into the cylinder to treat subsequent charges of wood, causing the CCA to react prematurely with extracted reducing sugars, etc., and with small particles of wood that are associated with wood treating solutions. This is not only uneconomic causing premature precipitation of the CCA, but can also be a major generator of hazardous wastes. This is particularly true when processes are used that increase the extractables in the CCA-containing wood treating solution, such as modified full-cell or modified empty-cell processes.

Normally, wood is treated while "bundled", that is, stacked and banded. "Stickering" is the act of placing thin strips or pieces of wood between each layer of lumber, which requires unbundling to accomplish. Present European practice for the heat fixing of CCA-treated wood by steam requires unbundling or stickering of the treated wood in order to reduce steaming time from about five hours to two and a half hours. Such stickering would be highly undesirable in the U.S.A., because it requires increased handling of the wood after treatment. If stickering is done before treatment, the extra spacing between the layers reduces the capacity of the pressure cylinder.

When preservative-impregnation is accomplished by high pressure, followed by a vacuum, the action of preservative chemicals returning to the treating solution during the low pressure phase is called "kickback".

Another environmental problem faced by wood treaters is that present treatment practice often leaves surface deposits of the treating chemicals in various stages of reaction that are easily washed off onto or into the soil by later rainfall, where they contaminate the environment.

OBJECTS OF THE INVENTION

It is the principal object of this invention to provide an economical, rapid process to secure fixation of wood preservatives in treated wood.

Another object of this invention is to provide a process which will wash off surface deposits of wood treating chemicals for recovery and recycling, so that they cannot become environmental contaminants.

It is also an object of this invention to provide a process that will result in quick fixation, with less than a quarter hour of heating, preferably from 3 to 5 minutes, of CCA treated wood.

Another object of this invention is to provide a process in which heating of any of the commercial wood species commonly treated with these chemicals cannot be overheated or attacked by destructively high temperature reactions.

Another object of this invention is to secure quick-fixation without depleting the wood of the required outer preservative concentration level.

Another object of this invention is to impart a uniform color to the quickly-fixed wood.

Another object of the invention is to prevent photokinetic changes that vary the color of applied dyes, stains, or pigments.

Another object of this invention is to obtain wood fixation without the need of an additional expensive pressure vessel.

Another object of this invention is to greatly shorten the amount of time required in dual preservative treatments, which require CCA curing or fixation before an other treatment can be applied.

Another object of this invention is to produce treated wood that upon removal from the treating area or drip pad cannot soil or contaminate workers or customers, or other handlers and users of the treated wood who might be sensitive to the impregnating chemicals.

Another object of this invention is to obtain this rapid fixation without the need to sticker or unbundle the wood.

Another object of this invention is to utilize this environmentally desirable process to gain an additional economic advantage to the treater using this process—weight reduction which will lower freight costs and expand the treater's market area.

Another object of this invention is to prevent wood discoloration that normally occurs by both migration of the wood treating chemicals to the surface and through photokinetic effects. The latter is prevented because fixation occurs out of sunlight and over a short period of time.

Another object of this invention is to provide a process to control surface rosin and treating chemical deposits.

Another object of this invention is to provide a process for the inexpensive addition of other chemical treatments that benefit from heating. These chemicals include but are not limited to coloring agents bound by air drying or heat fixing resins, flame-retardants, fungicides, water-proofing agents, anti-static agents, dimensional stabilizers, anti-checking agents, wood softening agents, and the like.

Another object of this invention is to provide a process for rapidly heating wood to accelerate the loss of ammonia and promote quick fixation of ammoniacal or amine complexed wood preservatives.

Another object of this invention is to reduce treated wood weight pickup an additional amount from the final treating weight that would prevail with either full or modified empty-cell treating processes.

Another object of this invention is to eliminate the need to heat while the wood treating chemicals are being held in the wood under pressure as taught in U.S. Pat. No. 4,303,705.

Another object of this invention is to allow the kickback to occur before the fixation process.

Another object of this invention is to eliminate the kickback step after heat fixation.

Another object of this invention is to raise the wood's temperature at a rate that will allow the wood to be removed from the fixing process in the time required by a modern plant to pressure treat wood, so that it can be put into the fixing process without slowing the production rate or reducing treating capacity.

Further objects and advantages of my invention will become apparent from a consideration of the ensuing detailed description and examples that follow.

SUMMARY OF THE INVENTION

After wood has been impregnated with any desirable chemical or chemical admixture such as a wood preservative, the invented process heats the treated wood rapidly through an aqueous liquid heating medium. In most cases water itself is a satisfactory heating medium. The wood can be introduced into the hot water, or the hot water onto or into the wood. Agitation (movement) of the liquid heating medium is preferable, but not mandatory. Alternatively, heating can take place, with no pressure applied, in the same pressure cylinder in which the wood has just been treated or in a separate atmospheric (no pressure) tank outside the pressure vessel. Because no pressure is required, it is anticipated that most treaters will prefer to use a separate lower cost vessel, thus avoiding reduction of plant capacity. This does not exclude a sealed vessel that generates slight pressure, such as a covered vessel. The time required for heating the wood is approximately 3 to 10 minutes, but contact with the heated water can be continued for an additional period of time without deleterious effect.

The invention achieves two very unexpected results:

1) the unexpected and great reduction in time from 2½ hours for steam fixing of wood preservatives to 3 to 10 minutes by contact of a liquid heating medium to achieve shallow fixation on unstickered American size bundles of wood; and
(2) proof that the distribution or content of the soluble wood preserving salts in the outer area of the wood does not leach out by heating the wood in water, in which they are highly soluble.

DETAILED DESCRIPTION

The foregoing and other objects of this invention are achieved by impregnating wood with the desired chemical materials using any commercially acceptable treating processes. The treated wood, with no need for unbundling or stickering, is then treated with a liquid heating medium, such as water, at a temperature of from 100 F. to 240 F., preferably from 140 to 212 degrees. In the invented process, the heating medium has been preheated to at least 100 F prior to contact with the wood, and minimum contact time is at least 3 minutes. Generally, the contact time can be from about 3 minutes to about ten minutes, but usually is from about 3 to about 5 minutes.

The liquid heating medium could be any aqueous solution that will not leave a residue which will wash off and contaminate the environment. Such mediums include water, solutions containing boiling point elevators, such as various aqueous salt solutions, aqueous ethylene glycol solution and suitable commercial heating fluids.

In the invented fixing process, the wood is impregnated with preservative with any standard process, such as full-cell, modified-full-cell, or modified-empty-cell processes. The lumber is immediately removed from the pressure cylinder and placed into the heat fixing process, making the cylinder available for the next charge of bundled wood. Thus capacity is unaffected, and the capacity of the most expensive part of the treating plant, the pressure cylinder, is not diminished. The process of the invention is not under pressure, thus avoiding the capital cost of purchasing an expensive pressure cylinder. Properly followed, the invented method does not contaminate the CCA working tank, thus avoiding precipitation problems.

Any means of immersing the wood into the hot water or the hot water into or onto the wood is satisfactory. The invention can be worked in the pressure cylinder by circulating hot water, or it can be worked by passing the treated wood into or through a hot water bath. A deluge of hot water can be passed over the wood. Contact must be maintained between the wood and the hot water until sufficient heat energy has been transferred into the wood to fix the preservative in the desired time period after removal from the heating bath, generally from 3 to 5 minutes.

Neither pressure nor an aqueous bath containing the treating chemicals as taught by Kelso, U.S. Pat. No. 4,303,705 are required. If a modified empty-cell in which kickback is used to reduce the final weight of the treated wood is desired, kickback is permitted before the wood is heated with the water as taught by my invention. Preliminary heating with air or other means as taught by Stanek et. al., U.S. Pat. No. 4,716,054 is not required. Neither are Stanek's two stages nor his use of steam to prevent "the rapid removal of water required for the fixing reaction" required. (See Stanek: column 2, lines 1-2.) Stanek's steam treatment cannot be equated with the invented water treatment. The novelty of the invented process lies in the use of hot water, which heretofore was not believed possible, if the desirable rapid fixation were to be accomplished. The invented process differs substantially from Stanek's. Directly after the impregnation, the wood is removed from the treating cylinder and hot water is employed as the fixing agent; whereas directly after impregnation, Stanek heats with hot air, then fixes with steam.

It was commonly held by those skilled in the art that water could not be used because the high solubility of the CCA preservative in water would result in severe leaching of the outer layer of the treated wood. The American Wood Preservers Association requires that certain chemical retentions be presents in the outer layers of the wood. Leaching could also impair its visual performance. It could look like untreated wood, and its performance, rot and insect attack might be accelerated on the water washed surface giving, if not poor performance, impaired salability, i.e. due to mold growth on the wood's surface.

It was also taught in the prior art that the most rapid means of heating a substance is by vapor condensation. For example, in *Unit Operations of Chemical Engineering* by McCabe and Smith, 1956, Chapter Eight, entitled Flow of Heat, Table 8-1, Magnitudes of Heat-transfer Coefficients, the authors teach that the minimum difference in BTU's of heat transferred per hour per square foot of heated area per degree F. is 5,000 for steam (dropwise condensation), 1,000 for steam (film-type condensation), versus 300 for boiling water, and 50 for water (heating and cooling). Because of these teachings, the few commercial processes which heat-fix CCA use steam injected into a pressure vessel or into a dry kiln. In fact, applicant was led to spend a year of research into various steaming processes.

As is shown by the heat transfer table of McCabe and Smith, steam would be expected to heat at a rate of several hundred to possibly a thousand percent faster than a liquid heating medium such as water. The reverse was found to be true for this application.

For this process to be successful, i.e., it is important that the liquid (water) used for heating have a high quantity of heat stored in it before transferring this heat to the wood. The hotter the solution, the more rapidly the wood will be heated. It is also important that there be a sufficient quantity of water, or a means to rapidly heat the water, so that the heat is not exhausted before the wood reaches the temperature range at which fixation will be complete before the treated wood is taken off the drip pad area—48 hours in many states even though our development work and internal goals were for complete curing to be effected with less than one hour of heating and no more than 24 hours on the drip pad.

My research has shown that the surface of a 2" by 4" (2×4) piece of CCA-treated wood will fix almost instantaneously in 210 degree water. The inner boards of a bundle take longer to fix because of the time required for the temperature in the center of the bundle to approach the outer water temperature. On the other hand, the temperature at the center of the bundle will remain high for a longer period of time after the liquid heating medium is removed because of the insulating properties of the wood. Therefore, it continues to fix over time, thus the time-temperature relationship come into effect during the additional 24 to 48 hours on the drip pad.

Shallow treatment is sufficient for many uses, particularly for several types of fir, and other difficult to penetrate species of wood, wherein the wood preservative is fixed to a depth of about one-quarter inch from the surface. Only about 3 to 5 minutes is required to achieve this degree of fixation.

Tests were conducted on individual 2"×4"×10" pieces of Southern yellow pine boards. The boards were treated in the normal industry manner and then 24 hours later, rain was simulated by washing the boards 10 times with the same 500 ml of distilled water, after which the wash water was analyzed for copper, chrome and arsenic. These boards were also bored 10 times and the borings cut into pieces representing the first half-inch and second half-inch of the wood from the surface. The 10 pieces from each level were then soaked in 20 ml of water for two (2) weeks and the solution analyzed for copper, chrome and arsenic.

These same tests were then repeated on samples of wood that had been subjected to 20 minutes of heating by contact with heated water at 210 degrees F. in the "quick-fix" process of the present invention. The results of both are shown in Table I, below. The Wash Test illustrates the difference in rain water contamination achieved by the invented process. The borings illustrate the degree that the process has accelerated internal fixation.

TABLE I

| | Wash Test Avg. | | | Borings Average | | | | | |
|---|---|---|---|---|---|---|---|---|---|
| | | | | 0–.5 | .5–1 | 0–.5 | .5–1 | 0–.5 | .5–1 |
| | Cu | Cr | As | Cu | | Cr | | As | |
| Normal Treating (ppm) | 6.5 | 20.35 | 4.8 | 205 | 199 | 353 | 340 | 354 | 280 |
| Quick-Fix (ppm) | .11 | .1345 | .015 | 2.37 | 1.935 | .4975 | .345 | 4.9 | 3.4 |

Three (3) gallons of water were pressure sprayed on an 18 cubic foot wood bundle with a hand-held garden spray nozzle 30 minutes after treating with the modified full-cell process (but not with the invented hot water fixing process). Analysis showed 8.5 parts per million of copper, 54.5 ppm chrome, and 26.7 ppm arsenic. Under those same conditions, but with the same size bundle having been heated for 30 minutes at 200 degrees F. and then immediately sprayed, the results of a similar analysis were 2.4 ppm copper, 1.0 ppm chrome, 2.4 ppm arsenic.

Although there was some concern that the vat bath would wash out the CCA before it was fixed, test analyses of borings taken from lumber showed no significant retention difference between boards that had been heated by being submerged in hot liquid and those that had not. The results from treating with a 2½ percent solution of CCA showed the wood had 0.727 preservative retention, while with heating there was 0.735 retention, for a net gain with heating of 1.1%. When using a 1.6 percent solution of CCA, without heating retention was 0.3495, with heating retention was 0.3725. Again that is a slight improvement of 6.6%.

In another test, core samples were divided into 0–0.25", 0.25"–0.5", 0.5"–0.75" and 0.75"–1.0" zones and analyzer for chemical retention. The results, as set forth in Table II, also showed no significant differences in retention.

TABLE II

| | Zone | | | |
|---|---|---|---|---|
| | 0–.25" | .25–.5" | .5–.75" | .75–1" |
| Treated Unheated | .63 | .546 | .594 | .526 |
| Quick-Fix Process | .651 | .592 | .567 | .548 |

In prior art processes, treated faces of wood exposed to sunlight during fixing commonly turn a darker shade of green, causing problems where uniform color is important, and where colorants are applied during or after treatment. Various non-matching shades are obtained wherever this photokinetic effect occurs. The color of wood treated in multiple runs of 18 cu. ft. bundles by the present invention was observed. This color was a uniform moderate green, which did not change on exposure to sunlight.

In practicing my invention, it has been found possible to obtain fixation in the outer layer in as short a time as 3 minutes in the liquid heating medium at 210 degrees F. with nominal 2×4 sized pieces of wood. The outer layer of each piece of wood in a bundle of 2×4s has been fixed in 3 to 5 minutes in the liquid heating medium at 210 degrees F. Because wood is a poor conductor of heat, after the heat is in the wood, it is not quickly lost. Accelerated fixing continues as long as the treated wood is above ambient temperature. However, fixing of preservatives in only the outer layer of the wood is sufficient because such fixation helps prevent leaching of preservative chemicals from the wood.

Because of the environmental hazard of the chemicals used, many states require that freshly treated wood be kept on paved areas called "drip pads" for prescribed periods of time so that any treating chemical spillage can be contained. At present, the longest holding period believed to be required by any state is 48 hours. Where these laws are in effect, it is neither necessary nor economically desirable to complete fixation within the liquid heating medium. Depending on the conditions, such as temperature, at which the wood will be stored after removal from the liquid heating medium, either the time of heating or the temperature, or both, can be reduced so that fixation becomes completed during the required drip pad holding time rather than within the liquid heating medium. Many possible and desirable variations of time and temperature may be utilized to advantage by those skilled in the art.

Because of wood's poor heat conductivity, pieces whose shortest distance from a surface to the center is greater than two (2) inches will require more time to fix completely. Thin pieces, such as treated lattice work, will fix completely within a few minutes in the liquid heating medium.

This environmentally desirable process provides an additional economic advantage to the treater using this process—weight reduction, which will lower freight costs and thus tend to expand the treater's market area. This process provides additional weight reduction above that of the full cell or the modified full cell processes. The preservative-impregnated wood is brought into contact with an aqueous liquid heating medium preheated to at least 100 degrees F. Both liquid contact and raised temperature of the wood is maintained for a period of time from 3 minutes up to 2 hours, raising the temperature of the wood from ambient to from 100 F. to 240 F. Upon removal from the hot water, the residual heat in the wood evaporates much of the water remaining in the wood, driving it off and reducing the weight of the treated wood.

Other chemicals may be added to the treating solution or fixing medium for a secondary treatment, such as color dyes and pigments, heat fixing resins, flame-retardants, fungicides, waterproofing agents, anti-static agents, dimensional stabilizers, anti-checking agents, wood softening agents, and the like. The process also allows the rosin and other wood sugars in the wood to be brought out of the wood, washed off, and collected. This prevents the wood from becoming sticky, rosin-blotched, or discolored by the organics, either as they seep out of the wood over a period of time, or are brought to the surface of the wood by the heat treatments. With the wood sugars or organics reduced to a low level, the bath solution can be reused either for the heating vat or as make-up water for the treating solution without fear of causing precipitation.

ALTERNATIVE EMBODIMENTS

It should be noted that the invented process eliminates photochromic color variation.

Glow retardants are sometimes added to CCA treating solutions to prevent glowing combustion of wood. This process is equally applicable to wood impregnated with such glow retardants.

SUMMARY OF THE ACHIEVEMENT OF THE OBJECTS OF THE INVENTION

From the foregoing, it is readily apparent that I have invented a method for treating wood for extended useful life, which treatment fixes a treating agent within the wood faster than has heretofore been possible, without the need to sticker or unbundle the wood, which eliminates certain environmental hazards by avoiding ground or personnel contamination from treatment chemicals, and which is compatible with a large variety of secondary treatments. The treated wood, upon removal from the treating area or drip pad, cannot soil or contaminate workers or customers, or other handlers and users of the treated wood who might be sensitive to the impregnating chemicals, and has the economic advantage to the treater using this process of low treated wood weight, which lowers freight costs and tends to expand the treater's market area.

What is claimed is:

1. A process for accelerated fixing of heat-fixable wood preservatives in wood, comprising:

contacting preservative-impregnated wood with an aqueous heated liquid heating medium preheated to at least 100 degrees F.;

raising the temperature of the wood from ambient to from 100 F. to 240 degrees F.; and maintaining both liquid contact and raised temperature of the wood for a period of time from about 3 minutes up to about 10 minutes;

whereby fixation in the outer layer occurs within 3 minutes, and complete fixation occurs in less than 48 hours.

2. A process according to claim 1 wherein complete fixation occurs in less than 24 hours.

3. A process according to claim 1 wherein said liquid heating medium is selected from the group consisting of water and aqueous solutions of boiling point elevators.

4. A process according to claim 3 wherein said boiling point elevator is a salt.

5. A process according to claim 3 wherein said boiling point elevator is ethylene glycol.

6. A process according to claim 1 wherein said contacting is accomplished by immersing said wood in said heated liquid heating medium.

7. A process according to claim 1 wherein said contacting is carried out by spraying said heated liquid heating medium onto said wood.

8. A process according to claim 1 wherein said contacting is carried out by causing said heated liquid heating medium to flow over and around said wood.

9. A process according to claim 1 wherein said preservative-impregnated wood is arranged in a bundle, and the contacting is accomplished by pumping said liquid heating medium through the bundle along the grain of said wood.

10. A process according to claim 6 further comprising agitating the heated liquid heating medium to accelerate contact between the liquid heating medium and the preservative-impregnated wood.

11. A process according to claim 1 wherein said fixable wood preservative contains chromium.

12. A process according to claim 1 wherein said fixable wood preservative contains ammonia or amine.

13. A process according to claim 11 wherein said wood preservative is CCA.

14. A process according to claim 11 wherein said wood preservative contains CCA and glow retardant.

15. A process according to claim 11 wherein said wood preservative contains CCA and fire retardant.

16. A process according to claim 1 wherein said liquid heating medium is heated to a temperature of from 140 degrees F. to 212 degrees F.

17. A process according to claim 1, further comprising adding to the liquid heating medium an additional treating agent from the group consisting of:

a. fire retardants
b. softening agents
c. antichecking agents
d. film formers
e. coloring agents
f. dimensional stabilizers
g. fungicides,
h. waterproofing agents, and
i. antistatic agents.

18. A process according to claim 1 wherein the wood receives sufficient heat energy that complete fixation of the preservative in the outer layer is achieved during contact with the heated liquid heating medium.

19. A process for fixing fixable wood preservatives in preservative-impregnated wood, comprising:

contacting said preservative-impregnated wood for from 3 minutes up to 10 minutes with hot water preheated to at least 100 degrees F.;

accelerating the contact between the wood and the heated water until the wood receives sufficient heat energy that fixation of the preservative will be achieved in less than 48 hours; and removing the wood from contact with the water, and allowing fixation to continue for up to 48 hours.

20. A process according to claim 19 wherein the wood receives sufficient heat energy that complete fixation of the preservative will be achieved in less than 24 hours; and allowing fixation to continue for up to 24 hours.

21. A process according to claim 19 wherein the wood receives sufficient heat energy that complete fixation of the preservative in the outer layer is achieved during contact with the heated water.

22. A process according to claim 19 wherein the preservative-impregnated wood is heated by contact with water in an agitated solution.

23. A process according to claim 22 wherein the preservative-impregnated wood is in a bundle and agitation comprises pumping the heated water through the bundle of wood.

24. A process according to claim 19 wherein the preservative-impregnated wood is moved into and out of the heated water.

25. A process according to claim 19 wherein the wood preservative contains CCA and glow retardant.

26. A process according to claim 19, further comprising adding to the hot water at least one additional treating agent selected from the group consisting of: fire retardants, softening agents, antichecking agents, film formers, coloring agents, dimensional stabilizers, fungicides, waterproofing agents, and anti-static agents; whereby such treating agents impart their desirable properties to said preservative-impregnated wood.

27. A process for eliminating photochromic color variation in wood impregnated with heat-fixable wood preservatives, comprising:

contacting preservative-impregnated wood with an aqueous liquid heating medium;

raising the temperature of the wood from ambient to from 100 F. to 240 degrees F.; and maintaining both liquid contact and raised temperature of the wood for a period of time from 3 to 10 minutes;

whereby complete fixation occurs in less than 48 hours.

28. A process according to claim 27 wherein said liquid heating medium is selected from the group consisting of water and aqueous solutions of boiling point elevators.

29. A process according to claim 28 wherein said boiling point elevator is a salt.

30. A process according to claim 28 wherein said boiling point elevator is ethylene glycol.

31. A process for accelerated fixing of heat-fixable wood preservatives in wood, comprising:

contacting preservative-impregnated wood with an aqueous liquid heating medium;

heating said liquid heating medium to a temperature of at least 100 degrees F after said wood is contacted by said liquid heating medium;

raising the temperature of the wood to from 100 F. to 240 degrees F.; and maintaining both liquid contact and raised temperature of the wood for a period of time from 3 to 5 minutes;

whereby complete fixation of preservatives occurs in less than 48 hours.

32. A process for producing a low-weight heat-fixed preservative-containing wood, comprising:

contacting preservative-impregnated wood with an aqueous liquid heating medium preheated to at least 100 degrees F.;

raising the temperature of the wood from ambient to from 100 F. to 240 degrees F.;

maintaining both liquid contact and raised temperature of the wood for a period of time from 3 minutes up to 2 hours, thereby fixing the preservative in the outer layer;

terminating liquid contact with the wood; and driving off a portion of the water contained in the wood, and reducing the weight of the treated wood, whereby a low-weight, heat-fixed, preservative-impregnated wood product is produced.

33. A process for producing a low-weight heat-fixed preservative-containing wood according to claim 32, wherein a portion of the water contained in the wood is driven off by evaporation promoted by the residual heat in the wood.

* * * * *